US009527561B1

(12) United States Patent
Stout

(10) Patent No.: US 9,527,561 B1
(45) Date of Patent: Dec. 27, 2016

(54) UNDERWATER GAS PRESSURE REGULATION SYSTEM

(71) Applicant: Exelis Inc., McLean, VA (US)

(72) Inventor: Paul C. Stout, Panama City, FL (US)

(73) Assignee: Exelis, Inc., McLean, VA (US)

( * ) Notice: Subject to any disclaimer, the term of this patent is extended or adjusted under 35 U.S.C. 154(b) by 412 days.

(21) Appl. No.: 14/199,428

(22) Filed: Mar. 6, 2014

(51) Int. Cl.
*B63G 8/14* (2006.01)
*B63C 11/22* (2006.01)

(52) U.S. Cl.
CPC ..... *B63C 11/2227* (2013.01); *B63C 11/2209* (2013.01); *B63G 8/14* (2013.01)

(58) Field of Classification Search
CPC ..... B63G 8/00; B63G 8/08; B63G 8/14; B63G 8/16; B63G 8/22; B63G 8/24; B63G 8/34; B63C 11/02; B63C 11/18; B63C 11/22
USPC ..... 114/331; 367/172
See application file for complete search history.

(56) References Cited

U.S. PATENT DOCUMENTS 3,803,544 A * 4/1974 Wallen ..... G10K 11/006 367/172
3,952,349 A * 4/1976 Erath ..... B63G 8/14 114/331
8,069,808 B1 * 12/2011 Imlach ..... B63G 8/22 114/331

OTHER PUBLICATIONS

"Consensus Standards for Commercial Diving and Underwater Operations," Association of Diving Contractors International, 5th edition, 2004, Best Publishing Company, Flagstaff, Arizona.
"NPR4100 Series—Negative Pressure Regulator Stainless Steel," Parker Hannifin Corporation, Veriflo Division, Apr. 2013, Richmond, California, retrieved from http://www.parker.com/docs/Literature/Veriflo/25000153_NPR4100.pdf.
"Check Valves," Swagelok Company, Apr. 2013, retrieved from http://www.swagelok.com/downloads/WebCatalogs/ en/MS-01-176.PDF.

* cited by examiner

*Primary Examiner* — Lars A Olson
(74) *Attorney, Agent, or Firm* — Edell, Shapiro & Finnan LLC

(57) ABSTRACT

An apparatus is provided for underwater operation comprising a pressure regulator configured to reduce a pressure of a gas received from a gas source at a first pressure to a second, lower pressure. A multiport differential pressure regulator is provided to receive the gas at the second pressure at a first port and to provide the gas to a second port at a differential pressure relative to an ambient pressure that varies based on a depth of the apparatus, where the differential pressure is set to a pressure that is at least 0.1 PSI below ambient pressure. A check valve vent is coupled to the second port of the multiport differential pressure regulator to relieve pressure at the second port accumulated by the apparatus during operation at a higher pressure depth when the apparatus rises from the higher pressure depth to a lower pressure depth.

20 Claims, 3 Drawing Sheets

UNDERWATER GAS PRESSURE REGULATION SYSTEM

FIELD OF THE INVENTION

Embodiments of the present invention relate to a pressure regulation system for supplying gas at a pressure relative to ambient underwater pressure to operate an underwater apparatus.

BACKGROUND

In underwater systems, the combination of atmospheric pressure and water pressure dictates constraints for physical equipment that operates in an underwater environment. For example, self-contained underwater breathing apparatus (SCUBA) gear provides air to a human diver at a pressure that is consistent with the diver's current depth. In such air delivery systems, a first stage regulator compensates for a first level of pressure differential between a high-pressure air source, e.g., a 3000 pound per square inch (PSI) air tank, and a low-pressure hose, while a second stage pressure regulator, e.g., a diver's "in-mouth" or mouthpiece regulator, safely delivers air from the low-pressure hose to the diver's lungs.

The mouthpiece regulator is a "demand" valve configured with a given pressure differential for which a user has to provide a "cracking" pressure (e.g., a small amount of suction) in order to initiate or "demand" a flow of air to the user/diver. These scuba-like systems are not configured for operation with electro-mechanical or mechanical devices that use differential pressures relative to the ambient underwater pressure.

SUMMARY

According to the techniques described herein, an apparatus is provided that is configured for underwater operation. A pressure regulator configured to reduce a pressure of a gas received from a gas source at a first pressure to a second, lower pressure. A multiport differential pressure regulator is configured to receive the gas at the second gas pressure at a first port and provide the gas to a second port at a differential pressure relative to an ambient pressure, where the ambient pressure varies based on a depth of the apparatus. A check valve vent is coupled to the second port of the multiport differential pressure regulator to relieve pressure at the second port accumulated by the apparatus during operation at a higher pressure depth when the apparatus ascends from the higher pressure depth to a lower pressure depth.

These and other objects, features and advantages of the present general inventive concept will be apparent from the following detailed description of illustrative embodiments thereof, which is to be read in connection with the accompanying drawings.

DETAILED DESCRIPTION

As described above, scuba systems consist of an air tank and a high-pressure regulator followed by a second stage mouthpiece regulator. The mouthpiece regulator is configured with a given negative pressure differential for which a user has to provide a cracking pressure equivalent to a small amount of suction in order to initiate a flow of air to the diver. For example, in diving terms, the cracking pressures for mouthpiece regulators vary from approximately 0.5 to 1.5 inches of water pressure (approximately −0.018 to −0.054 PSI). In this regard, divers are comfortable with cracking pressures of one inch of water or less. At cracking pressures of ~1.6 inches of water, some divers start to struggle to breath, and at cracking pressures of 2 inches of water (approximately −0.072 PSI), most divers would find breathing taxingly difficult.

Given the above-described limitations, these scuba-like systems do not provide pressures compatible with electro-mechanical or mechanical devices that may use differential pressure relative to the ambient underwater pressure for operation. For example, the negative differential pressures that may be used by the techniques described herein (should a negative differential pressure be used) are not compatible with human divers. In this regard, even a pressure differential of −1 PSI (i.e., at ambient pressure minus 1 PSI) is 14 times lower than the cracking pressures that would cause most divers to rise to the surface. Furthermore, the secondary mouthpiece valves have oval configurations designed to fit a human mouth, and therefore also suffer deficiencies in that the oval configurations are not geometrically compatible with those mechanical devices that use differential pressure.

In one embodiment, a pressure compensation and depth control system (PCDCS) allows for adjustable automatic supply of air (or other compressed gas) at a fixed difference in pressure from the ambient pressure of the underwater environment. The air provided at fixed (or within a range of pressures) difference from ambient pressure to allow for proper operation of an underwater mission package, e.g., an acoustic generator. The acoustic generator may be designed for fixed depth operation and is not configured to operate at a depth other than a given design or fixed pressurization depth. For example, the acoustic generator may be designed to be pre-pressurized for a given depth of operation. However, the techniques described herein permit operation of the same acoustic generator at depths other than its fixed-depth design.

Figure 1:
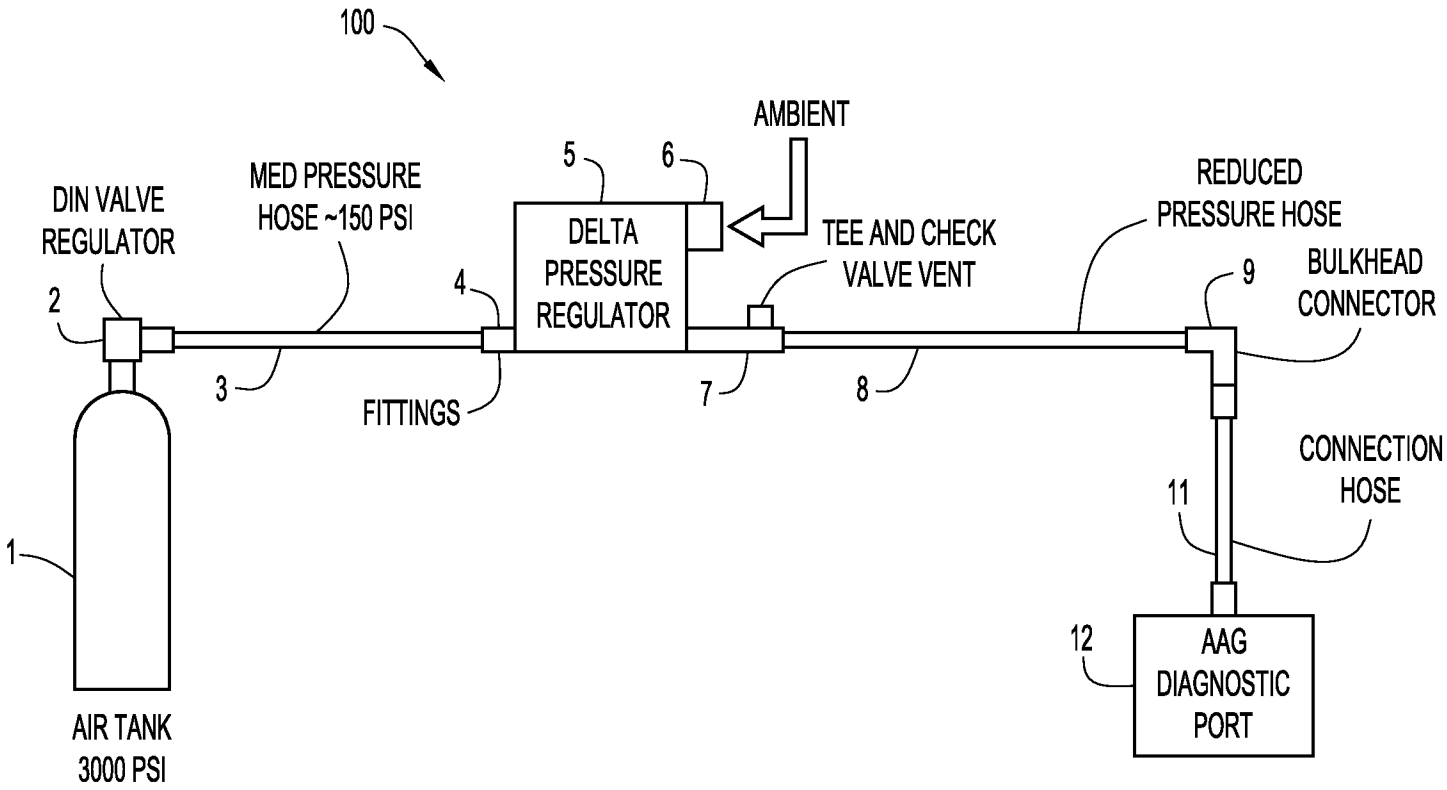
FIG. 1 is a schematic diagram illustrating an underwater pressure compensation system according to an embodiment of the present invention.

Referring to FIG. 1, a pressure compensation system is shown as generally indicated by reference numeral 100. A high-pressure (or relatively high) gas source 1 is provided, e.g., a 3000 PSI air tank. In general, the gas source may be an on-board tank, or an off-board or shipboard gas or air source. The high-pressure gas source 1 is regulated via a first stage pressure regulator 2 down to an intermediate pressure that is less that the pressure provided by the high-pressure gas source, e.g., 150 PSI. The intermediate pressure gas is delivered by a medium pressure hose 3. The medium pressure hose is couple to a second stage delta pressure regulator 5 by way of input port 4 with the appropriate fittings.

The delta pressure regulator 5 may be a three-port regulator comprising a higher pressure (e.g., 150 PSI) input port 4, an ambient pressure port 6 and an output port coupled to a tee and check valve vent combination 7. The delta pressure regulator 5 may be a pneumatic regulator provided by the Parker-Hannifin Corporation (e.g., the NPR 4100 series), while the tee and check valve combination 7 may be provided by Swagelok Inc. In this regard, the Parker-Hannifin and Swagelok components are not generally designed for underwater operation, but for above-ground pneumatic operation. Further, the delta pressure regulator 5 supplies gas at the regulated pressure, e.g., at positive pressures or pressures below ambient minus 0.072 PSI. The output of the check valve 7 is coupled to a reduced pressure hose 8 and is configured to relieve backpressure from the reduced pressure hose 8, e.g., during ascent (i.e., when the pressure compensation system 100 transitions from a higher pressure depth to a lower pressure depth). The delta pressure regulator 5 may provide gas at a pressure that may be the same as the ambient pressure, at a positive pressure relative to ambient pressure or a negative pressure relative to ambient pressure depending on the valve's configuration.

For compactness of design, the pressure compensation system 100 may include an optional 90-degree bulkhead connector 9. When the 90-degree bulkhead connector 9 is included, an additional connection hose 11 may be included. Reduced pressure hose 8 or connection hose 11 is ultimately connected to downstream equipment. In the example described herein, the downstream equipment comprises an Advanced Acoustic Generator (AAG), shown in FIG. 2, that includes an AAG diagnostic port 12 that includes the fittings for coupling to reduced pressure hose 8 or connection hose 11.

The pressure compensation system 100 can be configured to deliver air to a piston cavity of the AAG at a pressure that is automatically compensated for based on a current (ambient) pressure at depth. The check valve 7 is set at a specific difference in pressure between gas pressure supplied by the delta pressure regulator 5 and the pressure in the reduced pressure hose 8 to allow air pressure to be relieved from the AAG when it rises from a lower (higher pressure) depth (e.g., check valve 7 may be set to a cracking or relief pressure that is at least 0.1 PSI above the pressure in reduced pressure hose 8). For example, the relief pressure may be set to one-third PSI above the pressure supplied by the delta pressure regulator 5 such that as the pressure supplied by the delta pressure regulator 5 drops below the pressure in the reduced pressure hose 8 by one-third PSI, the relief/check valve 7 opens to relieve the gas pressure in the reduced pressure hose 8 or AAG 12. It should be understood that although tank 1 is described as containing pressurized air, tank 1 may contain any gas suitable for the application at hand, e.g., nitrogen, carbon dioxide, etc.

Figure 2:
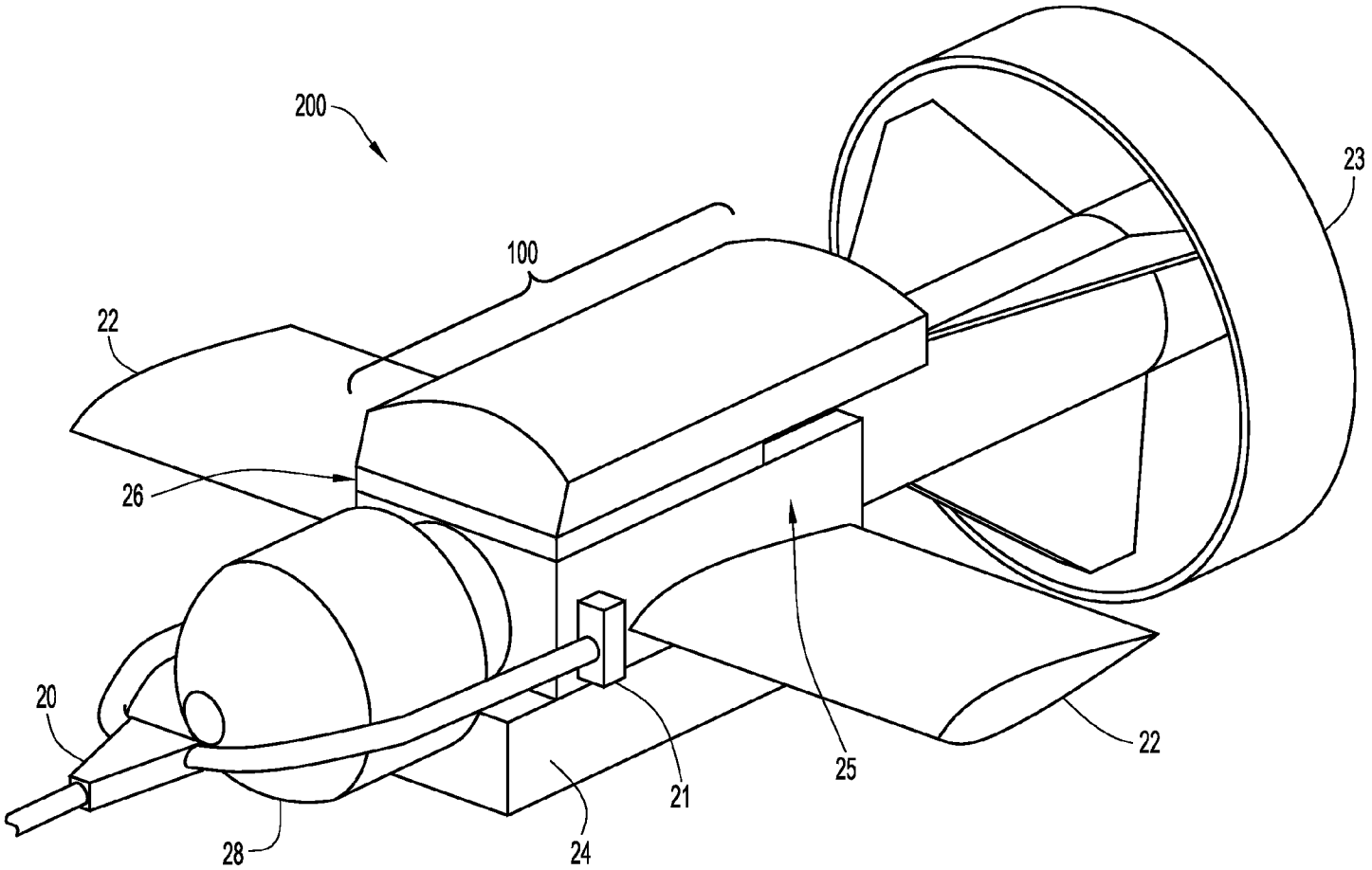
FIG. 2 is a system diagram for an underwater mission system that employs the pressure compensation system depicted in FIG. 1 according to an embodiment of the present invention.

Referring to FIG. 2, a system diagram is shown for an underwater mission system 200 that employs the pressure compensation system 100 described above in connection with FIG. 1. The underwater mission system 200 depicted in FIG. 2 is in a towable configuration that may be towed by another aquatic vehicle, e.g., a frigate or patrol boat. Underwater mission system 200 includes a chassis that comprises a wing base 25 and supporting strongback 26, a stabilization fin 23, a tow bail boss 21 and a tow bail 20. The underwater mission system 200 further includes a wing assembly 22 comprising an actuator and linkage, and a mission package, e.g., an AAG 28 that includes diagnostic port 12 (FIG. 1). The wing assembly 22 controls the depth of the underwater mission system 200 by way of a depth measurement sensor and electronics box 24. Together, the wing assembly 22, depth measurement sensor and electronics box 24 forms a depth control system. In other embodiments, the wing assembly 22 and stabilization fin 23 may be replaced or modified with both vertical and lateral dynamic control systems.

The electronics box 24 includes an on-board computer system. The on-board computer system takes inputs from depth measurement sensor and calculates a correction for the actuator to adjust the control surfaces of the wing assembly 22 and adjust depth to a programmed value. The underwater mission system 200 continues to seek the programmed depth until the mission is complete and the underwater mission system 200 is removed from the water.

The components that make up the depth control system include adjustable wings 22 that have a positive and negative angle of attack (e.g., as referred to by the Greek letter alpha (a) in fluid dynamics), a submersible actuator that will adjust the wings, linkages connecting the actuator to the wings, mounting structures, an electronics box with self-contained power, stabilization fins, and cabling. As the underwater mission system 200 may be under tow with the attached equipment, the electronics 24 monitor the observed depth and compares it to the desired input or programmed depth. The on-board computer's software processes depth data and commands the actuator to adjust position, which in turn drives the wings to adjust depth.

The depth may be a fixed target, meaning that the system attempts to seek one input depth per mission. The computer software may be configured detect a forcible retrieval of the underwater mission system 200 (e.g., when the underwater mission system 200 does not achieve a commanded depth) and subsequently will switch the system into a recovery mode, in which the wings engage a full positive lift angle of attack to help drive the underwater mission system 200 up to the surface for recovery. In another example, the underwater mission system 200 may be self-guiding with a propulsion system and guidance package for regulating depth and direction.

The depth control portion of this system may be designed to accommodate a range of different speeds and depths. For example, to accommodate a mission package for an AAG, e.g., AAG 28, underwater mission system 200 may be designed for a speed from approximate 7-15 knots and have enough wing surface area to provide adequate lifting force to drive the underwater mission system 200 to different example depths that may be in excess of 84 meters. The 84 meter depth corresponds to about 100 PSI and the depth may be increased by increasing the pressure supplied by the first stage pressure regulator 2. Different mission packages may include designs that may be adjusted in both speed and depth for other installed mission packages, e.g., an underwater survey package.

As the underwater mission system 200 descends, the pressure increases on the delta pressure regulator 5 via the ambient pressure reference port 6. This ambient pressure from the environment forces a valve in the delta pressure regulator 5 to open (or close), which allows high-pressure air from the air tank to make its way through the delta pressure regulator 5. The high-pressure air is reduced by the delta pressure regulator 5 to maintain the differential pressure supplied in order to keep the AAG's piston functioning. The supplied pressure may be higher, lower or equal to ambient pressure depending on the pressure setting on the delta pressure regulator 5 and the design of the downstream equipment. The downstream equipment may be driven or powered, e.g., by work or work energy provided by the force of the pressurized gas. The downstream equipment may also operate by way of a battery, or other on-board or off-board power source.

The air/gas flows from the delta pressure regulator 5 to pressurize the AAG piston cavity. The pressure-regulated air from delta pressure regulator 5 allows the AAG 28 to operate at various depths (i.e., rather than at a fixed depth). By way of example, an AAG may be designed with an acoustic piston to be operated at an ambient depth of, e.g., 10 meters, with a pre-pressurized gas. The techniques provided herein allow variable depth operation of the AAG by providing a pressure to the AAG's acoustic piston that compensates for the actual depth of the AAG, i.e., rather than a fixed 10 meter example design depth, such that the air provided by compensation system 100 may act in lieu of or in combination with AAG pre-pressurization.

As the desired pressure is reached, the pressure downstream of the delta pressure regulator 5 begins to increase and closes the valve in the delta pressure regulator 5. It should be understood that the pressures provided by delta pressure regulator 5 may be adjusted to any desired differential pressure (positive or negative) to accommodate the given mission package.

As the underwater mission system 200 ascends back toward the surface waterline, the increasing pressure seen in the AAG piston cavity is relieved from the system through the check valve 7 in order to maintain proper operating conditions for the AAG or to allow mission package recovery operations. In one example, the AAG may be a naval mine countermeasures device that comprises a water driven, turbine powered acoustic generator that emulates ship noise. By emulating ship noise, the AAG can be used to facilitate detection of mines that are typically activated by a ship's noise signature. The underwater mission system 200 with the associated pressure compensation system 100 can be integrated into any naval mine sweeping system.

In one example, the mission package includes an AAG that is developed by Thales Australia Limited or "Thales Australia" which is part of the Thales Group.

Figure 3:
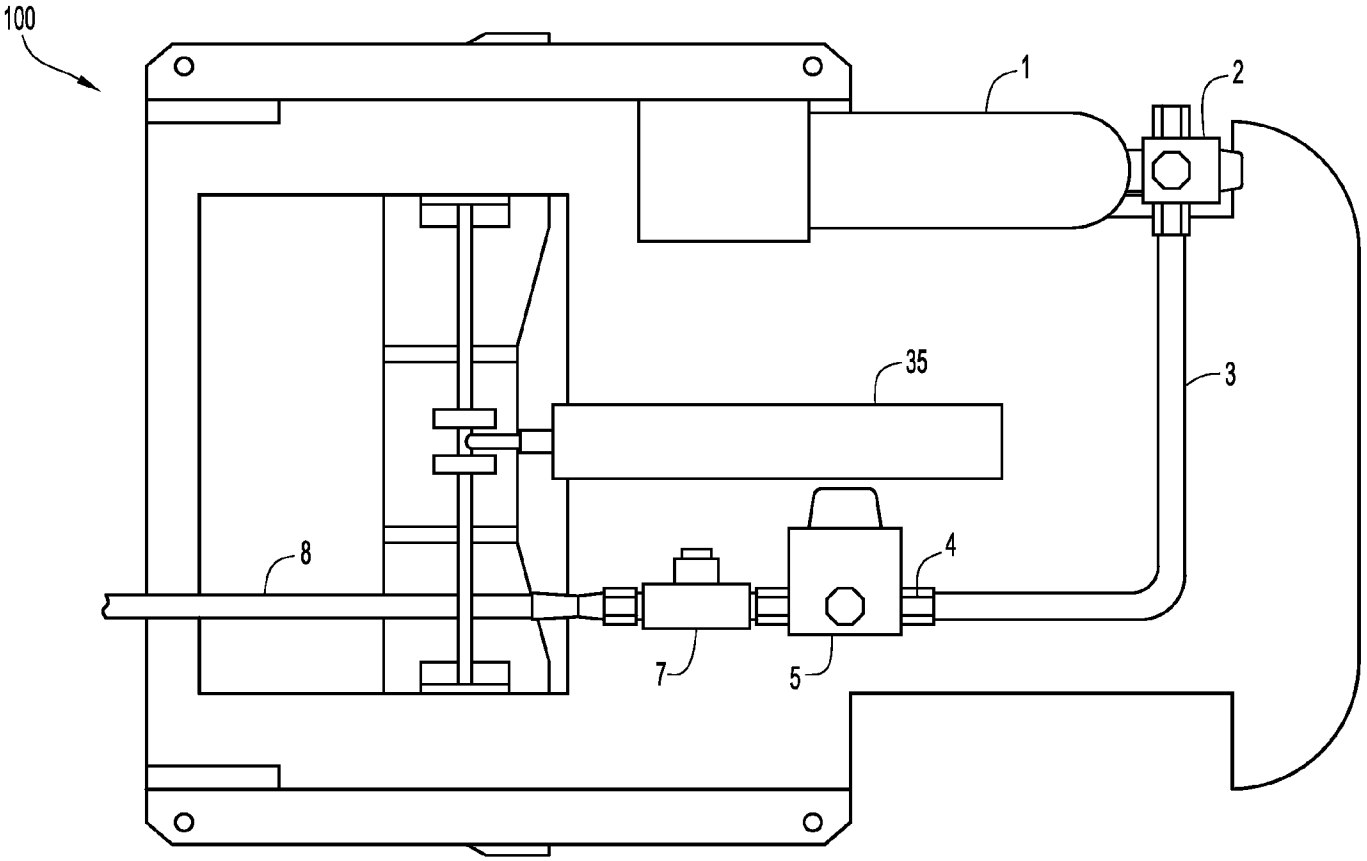
FIG. 3 is a schematic diagram illustrating an example configuration for the underwater pressure compensation system in a compact package that may be fitted to the underwater mission system.

FIG. 3 depicts an example physical configuration the pressure compensation system 100 shown in FIG. 1. FIG. 3 shows the high-pressure gas source 1, the first stage pressure regulator 2, the medium pressure hose 3, the input port 4, the second stage delta pressure regulator 5, the tee and check valve vent combination 7, and the reduced pressure hose 8. In addition, an example wing actuator 35 is shown that is configured to move the wing assembly 22 for controlling the depth of the pressure compensation system 100.

In sum, an apparatus is provided that is configured for underwater operation comprising a pressure regulator configured to reduce a pressure of a gas received from a gas source at a first pressure to a second, lower pressure. A multiport differential pressure regulator is provided that is configured to receive the gas at the second pressure at a first port and to provide the gas to a second port at a differential pressure relative to an ambient pressure that varies based on a depth of the apparatus, wherein the differential pressure is set to a pressure that is at least 0.1 PSI below ambient pressure. A check valve vent is coupled to the second port of the multiport differential pressure regulator to relieve pressure at the second port accumulated by the apparatus during operation at a higher-pressure depth when the apparatus rises from the higher-pressure depth to a lower pressure depth.

The multiport differential pressure regulator may comprise an ambient pressure port and the ambient pressure is measured at the ambient pressure port to provide a base pressure for determining the differential pressure by the multiport differential pressure regulator.

A maneuverable housing may be included that is configured to host the high-pressure gas source, the pressure regulator, the multiport differential pressure regulator and the check valve/vent, and configured to adjust an underwater depth of the apparatus. The maneuverable housing may be one of a towable housing configured to be towed and adjust its underwater depth, or the maneuverable housing is a self-guided housing configured to adjust its underwater depth and direction. The high-pressure gas source may comprise an on-board gas source or an off-board high-pressure gas source coupled to the maneuverable housing by way of a high-pressure hose.

The apparatus may further comprise a mission package. The mission package may comprise an acoustic generator. The acoustic generator is coupled to the second port and may be configured to operate using the gas at the differential pressure. The check valve vent is configured to vent gas at a relief pressure that is at least 0.1 PSI above a pressure supplied by the multiport differential pressure regulator to the check valve vent via the second port. The pressure settings for the multiport differential pressure regulator and the check valve vent have been described herein with respect to a 0.1 PSI differential (e.g., the differential pressure setting for the multiport differential pressure regulator is described as at least 0.1 PSI below ambient or −0.1 PSI below ambient, while the check valve vent is described as at least 0.1 PSI above supplied pressure, or +0.1 PSI above supplied pressure). It should be understood that while the differential pressure settings are both at a 0.1 PSI differential, the actual pressure settings are not the same, and it should be understood that the multiport differential pressure regulator need not be the same as the differential pressure setting for check valve vent.

In another embodiment, an underwater mission system is provided. The underwater mission system is configured for underwater operation and comprises an underwater pressure compensation system configured to provide pressurized gas at a differential pressure relative to an ambient water pressure, where the ambient water pressure varies based on an underwater depth of the underwater mission system; a mission package coupled to the underwater pressure compensation system and configured to operate using the pressurized gas at the differential pressure; and a maneuverable housing configured to host the underwater pressure compensation system and the mission package.

The underwater pressure compensation system may further comprise a gas source configure to supply gas at a first pressure, a pressure regulator for regulating the pressure of the gas from the gas source at the first pressure to a second pressure that is less than the first pressure, a multiport differential pressure regulator configured to receive the gas at the second gas pressure at a first port and provide the gas to a second port at the differential pressure, and a check valve vent coupled to the second port of the multiport differential pressure regulator that is configured to relieve pressure at the second port accumulated by the underwater mission system during operation at a higher pressure depth when the underwater mission system rises from the higher pressure depth to a lower pressure depth.

The multiport differential pressure regulator comprises an ambient pressure port and the ambient pressure is measured at the ambient pressure port to provide a base pressure for determining the differential pressure by the multiport differential pressure regulator.

The maneuverable housing may include one of a towable housing configured to be towed and adjust its underwater depth, or the maneuverable housing is a self-guided housing configured to adjust its underwater depth and direction. The underwater mission system may include a mission package comprising an acoustic generator.

The descriptions above are intended to illustrate possible implementations of the present inventive concept and are not restrictive. Many variations, modifications and alternatives will become apparent to the skilled artisan upon review of this disclosure. For example, components equivalent to those shown and described may be substituted therefore, elements and methods individually described may be combined, and elements described as discrete may be distributed across many components. The scope of the invention should therefore be determined not with reference to the description above, but with reference to the appended claims, along with their full range of equivalents.

What is claimed is:

1. An apparatus configured for underwater operation comprising:

a pressure regulator configured to reduce a pressure of a gas received from a gas source at a first pressure to a second, lower pressure;

a multiport differential pressure regulator configured to receive the gas at the second pressure at a first port and to provide the gas to a second port at a differential pressure relative to an ambient pressure that varies based on a depth of the apparatus, wherein the differential pressure is set to a pressure that is at least 0.1 PSI below ambient pressure; and a check valve vent coupled to the second port of the multiport differential pressure regulator, the check valve vent being configured to relieve pressure at the second port in response to the apparatus rising from a higher pressure depth to a lower pressure depth, wherein the differential pressure of the gas provided to the second port is automatically adjusted by the multiport differential pressure regulator based on the ambient pressure at varying depths of the apparatus.

2. The apparatus of claim 1, further comprising a maneuverable housing configured to host the pressure regulator, the multiport differential pressure regulator and the check valve vent, and configured to adjust an underwater depth of the apparatus.

3. The apparatus of claim 2, wherein the gas source comprises an on-board gas source or an off-board gas source coupled to the maneuverable housing by way of a hose.

4. The apparatus of claim 2, wherein the maneuverable housing is one of a towable housing configured to be towed and adjust its underwater depth and a self-guided housing configured to adjust its underwater depth and direction.

5. The apparatus of claim 1, further comprising a mission package which is configured to use the gas at the differential pressure that is at pressures not compatible with human underwater breathing.

6. The apparatus of claim 1, wherein the check valve vent is configured to vent gas at a relief pressure that is at least 0.1 PSI above a pressure supplied by the multiport differential pressure regulator to the check valve vent via the second port.

7. The apparatus of claim 6, wherein the check valve vent is configured to vent gas at a relief pressure that is at a pressure not compatible with human underwater breathing.

8. The apparatus of claim 1, further comprising a mission package including an acoustic generator.

9. The apparatus of claim 8, wherein the acoustic generator is coupled to the second port and configured to operate using work energy delivered by the gas at the differential pressure.

10. An underwater mission system configured for underwater operation comprising:

an underwater pressure compensation system configured to deliver pressurized gas to a mission package at a differential pressure relative to an ambient water pressure that varies based on a depth of the underwater mission system, wherein the differential pressure is set to a pressure that is at least 0.1 PSI below ambient pressure;

a mission package coupled to the underwater pressure compensation system and configured to operate using the pressurized gas at the differential pressure; and a maneuverable housing configured to host the underwater pressure compensation system and the mission package, wherein the differential pressure of the gas delivered to the mission package is automatically adjusted by the underwater pressure compensation system based on the ambient pressure at varying depths of the underwater mission system.

11. The underwater mission system of claim 10, wherein the underwater pressure compensation system further comprises:

a gas source configured to supply gas at a first pressure;

a pressure regulator for regulating the pressure of the gas from the gas source at the first pressure to a second pressure that is less than the first pressure;

a multiport differential pressure regulator configured to receive the gas at the second gas pressure at a first port and provide the gas to a second port at the differential pressure; and a check valve vent coupled to the second port of the multiport differential pressure regulator that is configured to relieve pressure at the second port accumulated during operation at a higher pressure depth when the underwater mission system rises from the higher pressure depth to a lower pressure depth.

12. The underwater mission system of claim 11, wherein the multiport differential pressure regulator comprises an ambient pressure port and the ambient pressure is measured at the ambient pressure port to provide a base pressure for determining the differential pressure by the multiport differential pressure regulator.

13. The underwater mission system of claim 11, wherein the gas source comprises an on-board gas source or an off-board gas source coupled to the maneuverable housing by way of a hose.

14. The underwater mission system of claim 10, wherein the maneuverable housing is one of a towable housing configured to be towed and adjust its underwater depth and a self-guided housing configured to adjust its underwater depth and direction.

15. The underwater mission system of claim 10, wherein the mission package is configured to use the gas at the differential pressure that is at pressures not compatible with human underwater breathing.

16. The underwater mission system of claim 12, wherein the check valve vent is configured to vent gas at a relief pressure that is at least 0.1 PSI above a pressure supplied by the multiport differential pressure regulator to the check valve vent via the second port.

17. The underwater mission system of claim 12, wherein the check valve vent is configured to vent gas at a relief pressure that is at a pressure not compatible with human underwater breathing.

18. The underwater mission system of claim 10, wherein the mission package comprises an acoustic generator.

19. The underwater mission system of claim 18, wherein the acoustic generator is coupled to the second port and configured to operate using work energy delivered by the gas at the differential pressure.

20. An apparatus configured for underwater operation comprising:

a pressure regulator configured to reduce a pressure of a gas received from a gas source at a first pressure to a second, lower pressure;

a multiport differential pressure regulator configured to receive the gas at the second pressure at a first port and to provide the gas to a second port at a differential pressure relative to an ambient pressure that varies based on a depth of the apparatus, wherein the differential pressure is set to a pressure that is at least 0.1 PSI below ambient pressure; and a check valve vent coupled to the second port of the multiport differential pressure regulator, the check valve vent being configured to relieve pressure at the second port in response to the apparatus rising from a higher pressure depth to a lower pressure depth, wherein the multiport differential pressure regulator comprises an ambient pressure port and the ambient pressure is measured at the ambient pressure port to provide a base pressure for determining the differential pressure by the multiport differential pressure regulator.

* * * * *